US005160251A

United States Patent [19]

Ciokajlo

[11] Patent Number: 5,160,251

[45] Date of Patent: Nov. 3, 1992

[54] LIGHTWEIGHT ENGINE TURBINE BEARING SUPPORT ASSEMBLY FOR WITHSTANDING RADIAL AND AXIAL LOADS

[75] Inventor: John J. Ciokajlo, Cincinnati, Ohio

[73] Assignee: General Electric Company, Cincinnati, Ohio

[21] Appl. No.: 698,879

[22] Filed: May 13, 1991

[51] Int. Cl.[5] ..... F01D 25/16

[52] U.S. Cl. ..... 415/142; 415/209.2

[58] Field of Search ..... 415/142, 209.2, 77; 60/39.31

[56] References Cited

U.S. PATENT DOCUMENTS

| | | | |
|---|---|---|---|
| 2,869,941 | 1/1959 | Shoup, Jr. et al. | 308/184 |
| 2,928,648 | 3/1960 | Haines et al. | 253/39 |
| 2,941,781 | 6/1960 | Boyum | 415/142 |
| 3,250,512 | 5/1966 | Petrie . | |
| 4,304,522 | 12/1981 | Newland | 415/135 |
| 4,428,713 | 1/1984 | Coplin et al. | 415/48 |
| 4,478,551 | 10/1984 | Honeycutt et al. | 415/142 |
| 4,492,518 | 1/1985 | Neal | 415/142 |
| 4,900,221 | 2/1990 | Ciokajlo et al. | 415/142 |
| 4,965,994 | 10/1990 | Ciokajlo et al. | 60/39.75 |
| 4,979,872 | 12/1990 | Myers | 415/142 |
| 4,987,736 | 1/1991 | Ciokajlo et al. | 415/142 |

FOREIGN PATENT DOCUMENTS

| | | | |
|---|---|---|---|
| 1040535 | 10/1978 | Canada . | |
| 926947 | 5/1963 | United Kingdom | 415/142 |
| 969579 | 9/1964 | United Kingdom . | |

*Primary Examiner*—Thomas E. Denion
*Attorney, Agent, or Firm*—Jerome C. Squillaro

[57] ABSTRACT

A gas turbine engine incorporates a bearing support assembly which mounts an inner annular bearing arrangement in radially spaced relation inwardly from a stationary outer casing. The bearing arrangement, in turn, mounts a turbine rotor within the outer casing for rotation about a central axis relative to the outer casing. A row of stationary stator vanes are fixedly attached to an extend radially inwardly from the outer casing toward the central axis. The bearing support assembly includes an inner ring structure extending about and mounting the inner bearing arrangement, elongated tie rods each having opposite outer and inner end portions and being disposed in circumferential spaced relation to one another and extending through the stationary vanes in radial relation to the central axis and between the outer casing and inner ring structure, and fastening elements fixedly clamping the outer casing and inner ring structure respectively to the outer and inner end portion of the tie rods such that the tie rods, outer casing and inner ring structure act together as a unit to uniformly distribute bearing-induced radial loads and to withstand bearing-induced radial loads in both tension and compression. An annular shell structure is disposed between and fixedly interconnects the inner ring structure and stationary vanes such that the annular structure, inner ring structure and stationary vanes act together as a unit to withstand axial loads induced by differences in air pressure existing axially through the outer casing.

15 Claims, 5 Drawing Sheets

LIGHTWEIGHT ENGINE TURBINE BEARING SUPPORT ASSEMBLY FOR WITHSTANDING RADIAL AND AXIAL LOADS

BACKGROUND OF THE INVENTION

1. Field of the Invention

The present invention relates generally to a gas turbine engine and, more particularly, to a lightweight turbine bearing support assembly for withstanding radial and axial loads in a gas turbine engine.

2. Description of the Prior Art

A gas turbine engine of the turbofan type generally includes a forward fan and booster compressor, a middle core engine, and an aft low pressure power turbine. The core engine encompasses a compressor, a combustor and a high pressure turbine in a serial flow relationship. The compressor and high pressure turbine of the core engine are interconnected by a central shaft. The compressor is rotatably driven to compress air entering the core engine to a relatively high pressure. This high pressure air is then mixed with fuel in the combustor and ignited to form a high energy gas stream. This gas stream flows aft and passes through the high pressure turbine, rotatably driving it and the core engine shaft which, in turn, rotatably drives the compressor.

In the turbofan engine, the residual gas stream leaving the core engine high pressure turbine is expanded through a second turbine, which as mentioned above is the aft low pressure turbine. The aft low pressure turbine, in turn, drives the forward fan via a separate shaft which extends forwardly through the central shaft of the high pressure turbine rotor. Although some thrust is produced by the residual gas stream exiting the core engine, most of the thrust produced is generated by the forward fan.

The engine frame is often used to support the bearings of the engine's turbines. Conventional bearing support frames are heavy, adding to the weight and cost of the engine. Also, the frames are subject to thermal stresses, thermal gradients and generally require flowpath heat shields if subjected to hot flowpath gases. These frames are massive in order to withstand large radial and axial loads. Conventional frames generally have radial or tangential struts positioned by axially spaced outer and inner rings to form an annular type, load bearing heavy structure. To protect this ring-strut structure from flowpath hot gases, a heat shield is required. Generally this heat shield is approximately the same weight as the bearing support frame, and equally costly.

Consequently, a need exists for an alternative bearing support assembly which will avoid the abovementioned drawbacks of excessive weight and cost.

SUMMARY OF THE INVENTION

The present invention provides a lightweight turbine bearing support assembly designed to satisfy the aforementioned needs. The bearing support assembly is capable of withstanding radial and axial loads in the turbine engine. The bearing support assembly of the invention performs the same function in the gas turbine engine as the conventional bearing support frame, but at a small fraction of the cost and weight relative thereto.

Accordingly, the present invention is directed to a bearing support assembly incorporated in a gas turbine engine. The turbine engine has a stationary outer annular casing, an inner annular bearing arrangement within the outer casing for rotation about a central axis relative the outer casing and inner bearing arrangement, and a plurality of stationary turbine stator vanes arranged in a circumferential row and fixed attached to and extending radially inwardly from the outer casing toward the central axis.

The bearing support assembly of the present invention comprises: (a) an inner ring extending about and mounting the inner annular bearing arrangement; (b) a plurality of elongated tie rods each having opposite outer and inner end portions, the tie rods being disposed in circumferential spaced relation to one another and extending through the stationary vanes in radial relation to the central axis and between the outer casing and the inner ring; and (c) means for fixedly clamping the outer casing and inner ring respectively to the outer and inner end portions of the tie rods such that the tie rods, outer casing and inner ring act as a unit to uniformly distribute bearing-induced radial loads and to withstand bearing-induced radial loads in both tension and compression. The bearing support assembly also includes an annular shell structure disposed between and fixedly interconnecting the inner ring and the stationary vanes such that the annular structure, inner ring and stationary vanes act as a unit to withstand axial loads induced by differences in air pressure existing axially through the outer casing.

More particularly, the clamping means of the bearing support assembly includes a set of external threads respectively formed on opposite terminal ends of the opposite outer and inner end portions of each tie rod, and a set of outwardly-protruding lands respectively formed on the opposite outer and inner end portions of each of tie rod and being spaced from the respective external threads by segments of the tie rod substantially equal in lengths to the thicknesses of the outer casing and inner ring. The clamping means also includes apertures defined in the outer casing and inner ring for receiving the segments of each tie rod so as to dispose the lands of the tie rod on opposite sides of the outer casing and inner ring from the locations of the external threads of the tie rod. The clamping means further includes a set of fasteners having internal threads which respectively screw onto the external threads on the opposite terminal ends of each tie rod toward the lands so as to fixedly clamp the outer casing and inner ring between the respective sets of fasteners and lands.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
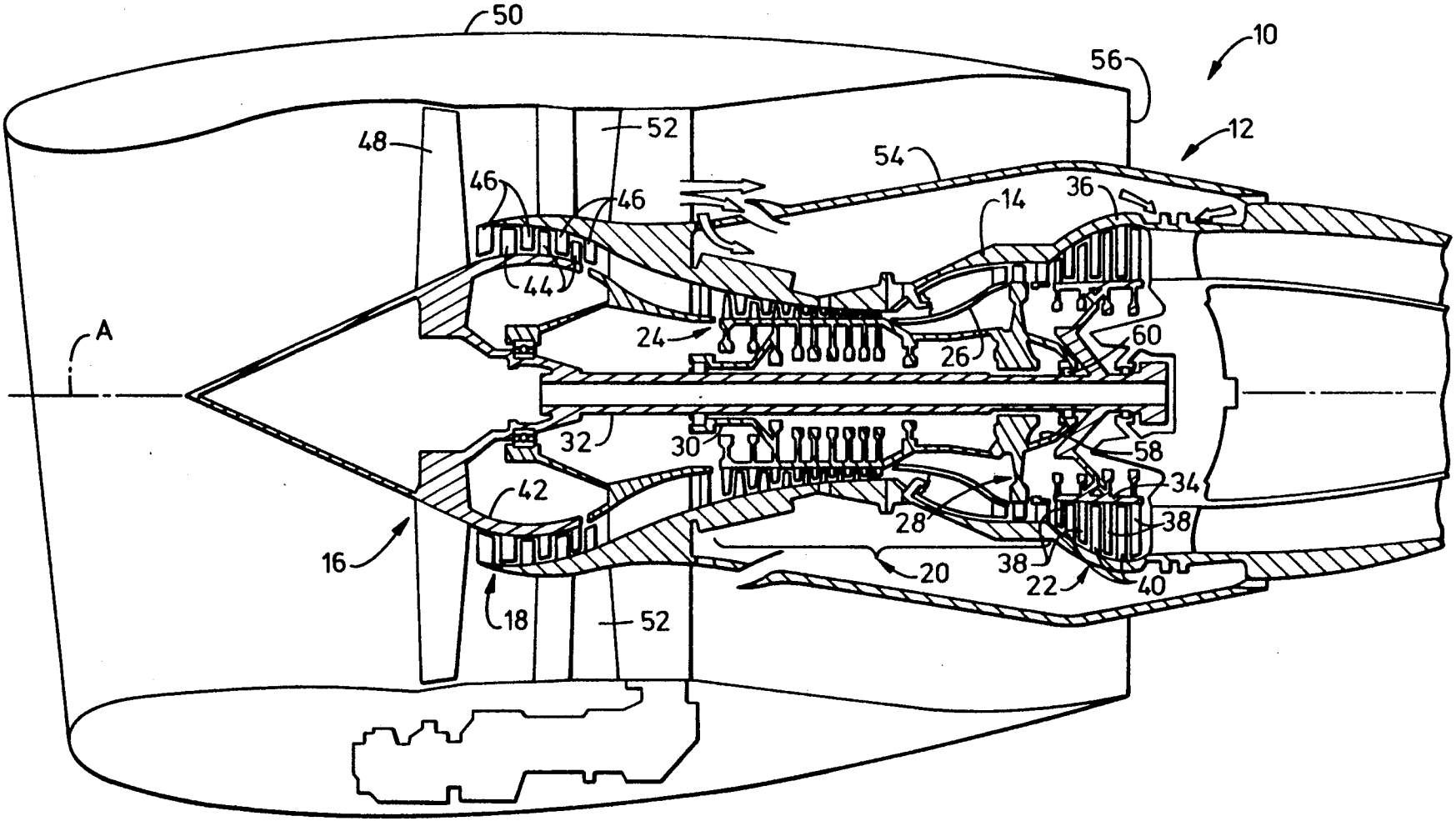
FIG. 1 is a longitudinal axial sectional view of a gas turbine engine capable of incorporating a lightweight turbine bearing support assembly of the present invention.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

In General

Figure 2:
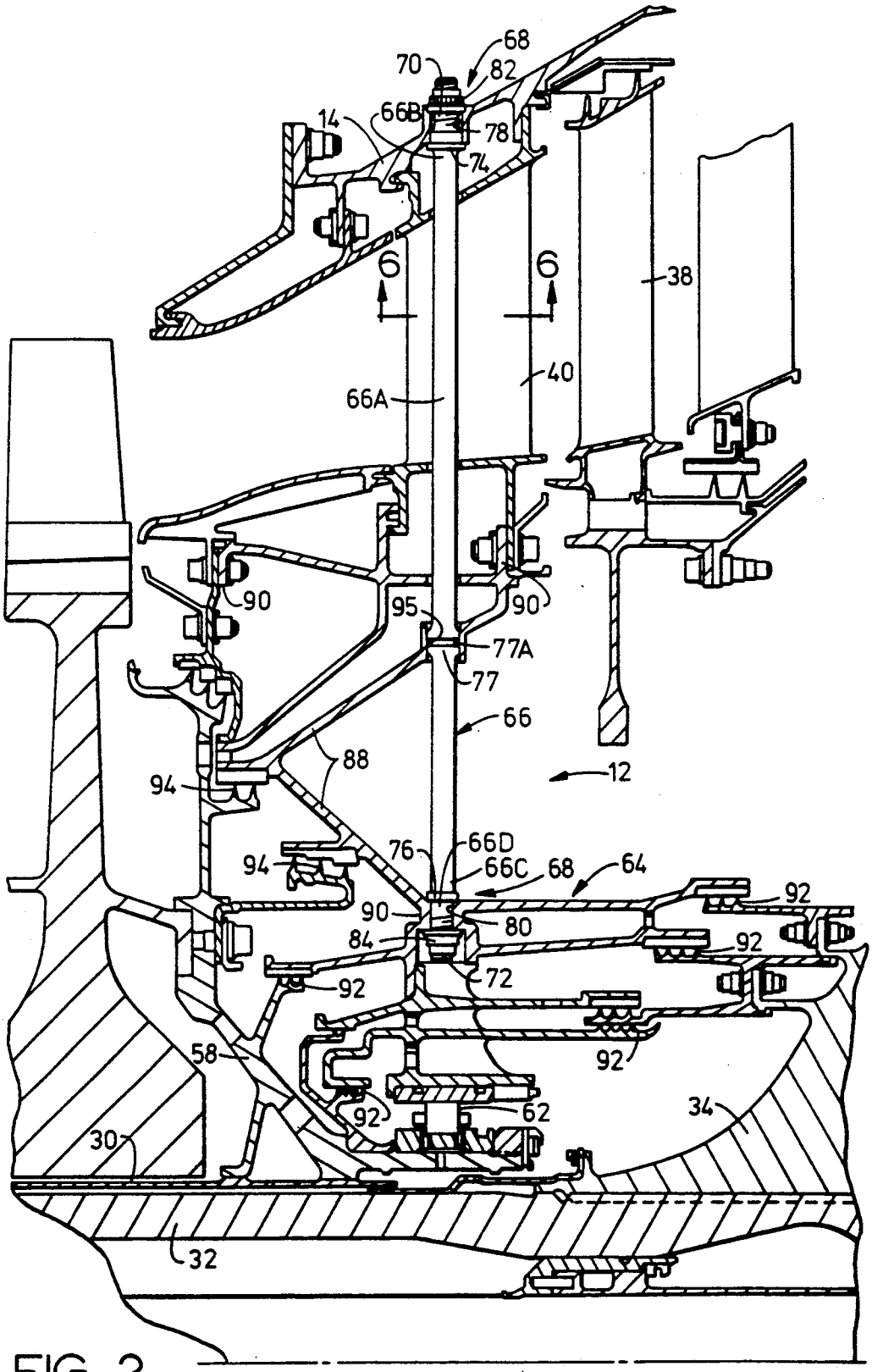
FIG. 2 is an enlarged fragmentary longitudinal axial sectional view of the turbine engine of FIG. 1, showing in detail the lightweight turbine bearing support assembly of the present invention incorporated in the engine.

Referring now to the drawings, and particularly to FIG. 1, there is illustrated a gas turbine engine, generally designated 10, capable of incorporating a lightweight turbine bearing support assembly 12 of FIG. 2 in accordance with the present invention. Although the gas turbine engine 10 being illustrated is of the turbofan type, it should be understood that the bearing support assembly 12 is applicable to other types of gas turbine engines.

Referring to FIG. 1, the engine 10 has a longitudinal center line or axis A and an outer annular casing 14 disposed coaxially and concentrically about the axis A. The engine 10 includes a forward fan 16 and booster compressor 18, a middle core engine 20 and an aft low pressure power turbine 22. The core engine 20 encompasses a multi-stage compressor 24, a combustor 26 and a high pressure turbine 28, either single or multiple stage, all arranged coaxially about the longitudinal axis A of the engine 10 in a serial flow relationship. An annular outer drive shaft 30 fixedly interconnects the compressor 24 and high pressure turbine 28 of the core engine 20. The compressor 24 is rotatably driven to compress air entering the core engine 20 to a relatively high pressure. This high pressure air is then mixed with fuel in the combustor 26 and ignited to form a high energy gas stream. This gas stream flows aft and passes through the high pressure turbine 28, rotatably driving it and the outer drive shaft 30 of the core engine 20 which, in turn, rotatably drives the multi-stage compressor 24.

In the engine 10 being of the turbofan type, the residual gas stream discharged by the core engine high pressure turbine 28 is expanded through a second, power turbine, which as mentioned above is the aft low pressure turbine 22. The aft low pressure turbine 22 is rotated by gas stream flow and, in turn, drives the forward fan 16 and booster compressor 18 via a separate inner drive shaft 32 which extends forwardly through the annular outer drive shaft 30 of the core engine 20. Although some thrust is produced by the residual gas stream exiting the core engine 20, most of the thrust produced is generated by the forward fan 16.

The low pressure turbine 22 includes an annular rotatable rotor 34 and a stationary stator 36 disposed radially outwardly of the rotor 34. The low pressure turbine rotor 34 includes a plurality of turbine blade rows 38 extending radially outwardly from the axis A and axially spaced from one another. The low pressure turbine stator 36 includes a plurality of stator vane rows 40 fixedly attached to and extending radially inwardly from the stationary casing 14 toward the axis A. The stator vane rows 40 are axially spaced so as to alternate with the turbine blade rows 34 and define therewith multiple stages of the low pressure turbine 22.

The forward booster compressor 18 driven by the low pressure turbine 22 via the inner drive shaft 32 includes a rotor 42 and a plurality of booster blade rows 44 fixedly attached to and extending radially outwardly from the rotor 42 for rotation therewith. A plurality of booster stator vane rows 46 are fixedly attached to and extend radially inwardly from the stationary casing 14. Both the booster blade rows 44 and the stator vane rows 46 are axially spaced and so arranged to alternate with one another.

The booster compressor rotor 42 also supports a fan blade row 48 of the forward fan 16. The fan blade row 48 is housed within a nacelle 50 of the engine 10 supported about the stationary casing 14 by a plurality of radially extending and circumferentially spaced struts 52. A cowling 54 which encloses the core engine 20 and low pressure turbine 22 is disposed within and extends coaxially with a rear portion of the nacelle 50 so as to define therewith the discharge nozzle 56. Most of the thrust produced by the engine 10 is generated by air flow caused by rotation of the fan blade row 48 of the forward fan 16, which air flow passes over and through the nacelle 50 and from the discharge nozzle defined by the nacelle 50 and engine cowling 54.

Bearing Support Assembly of Present Invention

In some turbofan engines, the annular rotatable rotor 34 of the low pressure turbine 22 rotatably mounts an annular rotor 58 of the high pressure turbine 28 by a differential bearing 60 (FIG. 1). Such mounting relationship means that should one of the turbine blades 38 be thrown off the lower pressure turbine 22 the vibrations created will be transmitted to the high pressure turbine 28.

Figure 3:
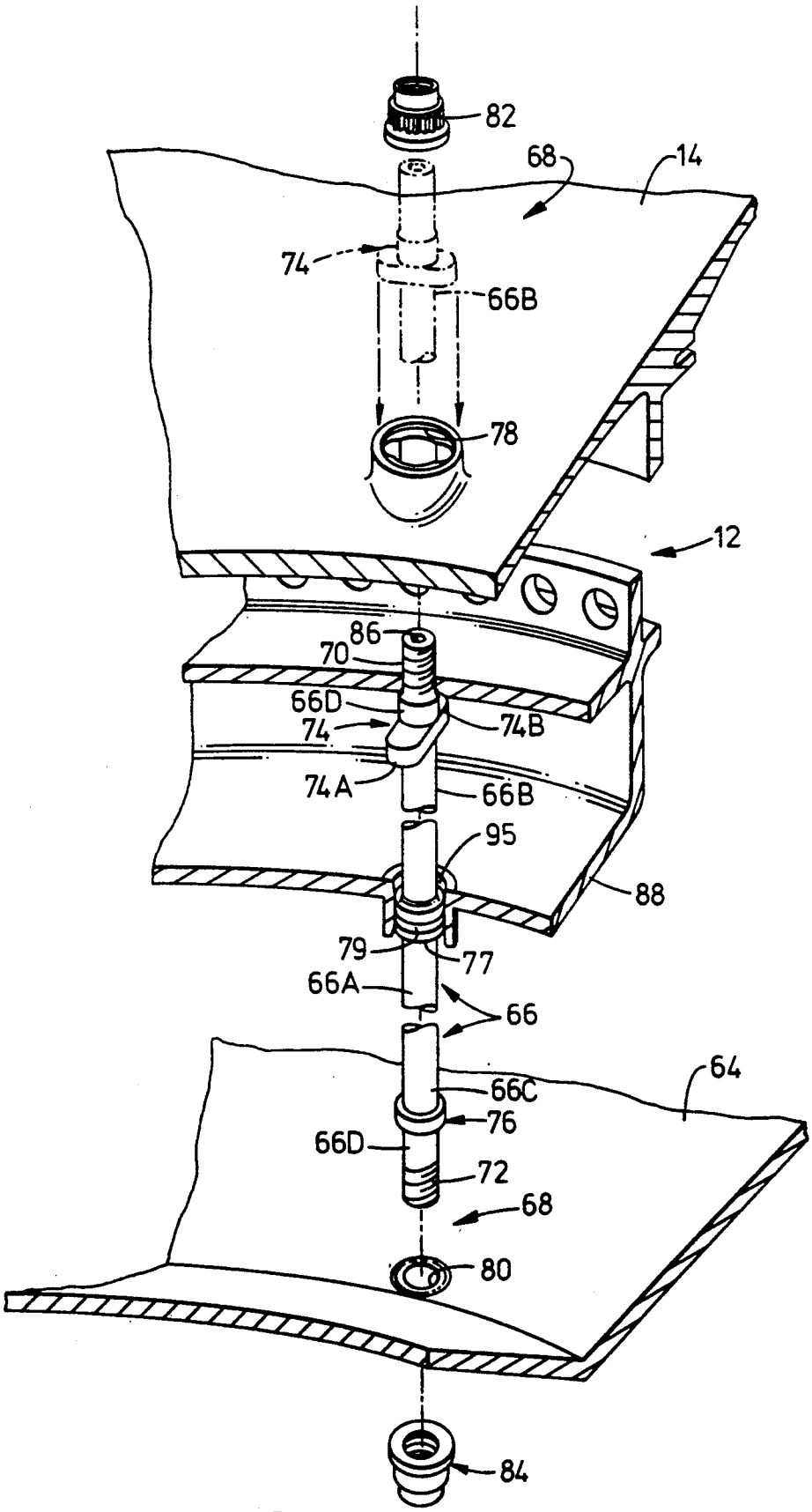
FIG. 3 is an exploded perspective view of a tie rod of the bearing support assembly of FIG. 2.
Figure 4:
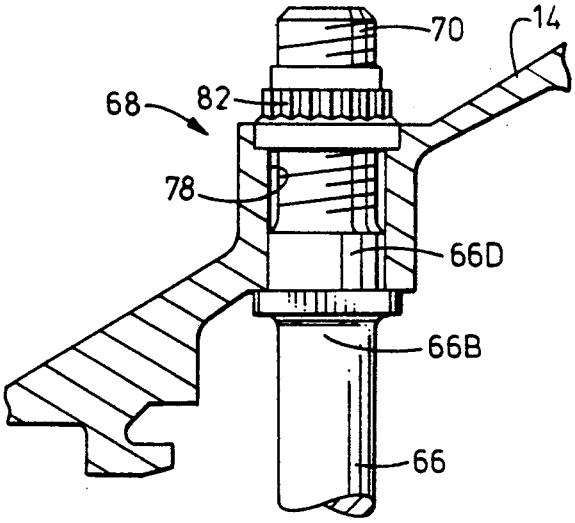
FIG. 4 is an enlarged fragmentary side elevational view of an upper end of the tie rod of FIG. 3.
Figure 5:
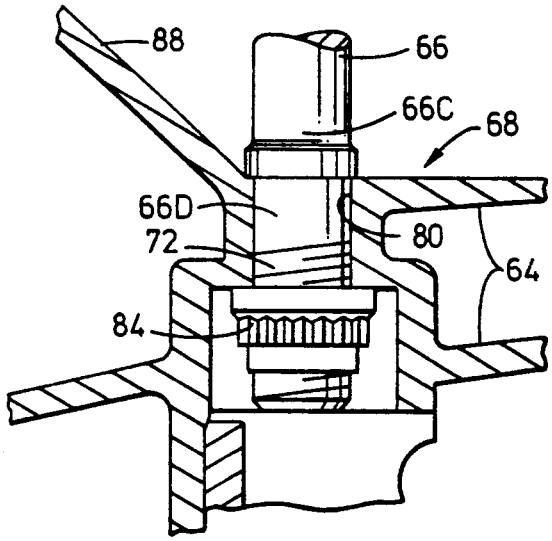
FIG. 5 is an enlarged fragmentary side elevational view of a lower end of the tie rod of FIG. 3.
Figure 6:
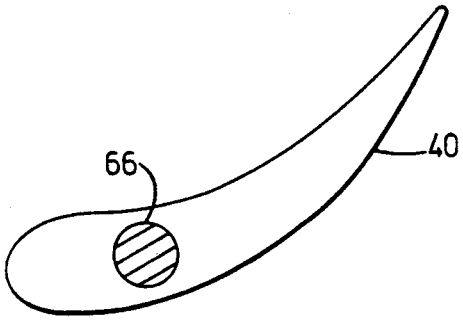
FIG. 6 is an enlarged cross-sectional view taken along line 6—6 of FIG. 2.
Figure 7:
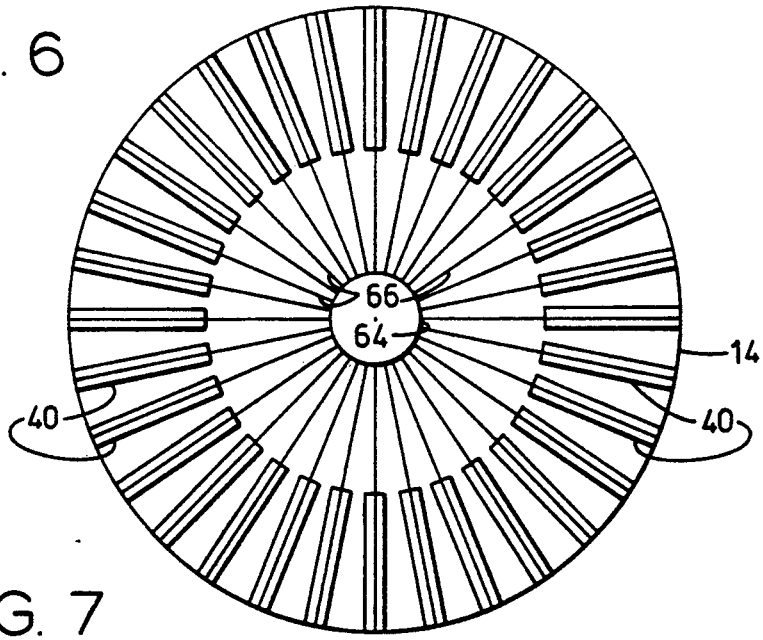
FIG. 7 is schematic cross-sectional view of the bearing support assembly of the present invention.

Referring to FIGS. 2 and 3, the bearing support assembly 12 of the present invention is disposed in alignment with the stator vanes 40 of the first stage of the aft low pressure turbine 22. The bearing support assembly 12 is separate from the annular rotor 34 of the low pressure turbine 22 and thus, independent of the low pressure turbine rotor 34, supports an inner annular bearing arrangement 62 in the form of a roller bearing which, in turn, rotatably mounts the annular rotor 58 of the high pressure turbine 28. Therefore, the bearing support assembly 12, in addition to providing a lightweight support assembly which substantially reduces weight and costs, provides isolation between the rotors 34, 58 of the low and high pressure turbines 22, 28 which avoids the problem of transmission of vibrations.

Referring to FIGS. 2, 3, 6 and 7, the bearing support assembly 12 basically includes an inner ring structure 64, a plurality of elongated radial tie rods 66 in the form of solid elongated shafts 66A having opposite outer and inner end portions 66B, 66C, and fastening, or clamping, elements or means 68 for fixedly clamping the outer casing 14 and inner ring structure 64 respectively to the outer and inner end portions 66B, 66C of the tie rods 66. The inner ring structure 64 extends about and mounts the inner annular bearing arrangement 62. The tie rods 66 are disposed in circumferential spaced relation to one another and, preferably although not necessarily, extend through the row of hollow stationary vanes 40 of the leading stage of the low pressure turbine 22. Also, the elongated tie rods 66 extend in radial relation to the central axis A and between the outer casing 14 and the inner ring structure 64. The radial tie rods 66, outer casing 14 and inner ring structure 64, which are fixedly attached or clamped together at the outer and inner end portions 66B, 66C of the tie rods by the clamping means 68, act together as a unit to uniformly distribute bearing-induced radial loads and to withstand bearing-induced radial loads in both tension and compression.

More particularly, referring to FIGS. 2-5, the clamping means 68 includes a set of outer and inner external threads 70, 72 formed on the respective opposite terminal ends of the opposite outer and inner end portions 66B, 66C of each tie rod 66, and a set of outer and inner lands 74, 76 formed on the respective opposite outer and inner end portions 66B, 66C of each tie rod 66. The outer and inner lands 74, 76 are displaced from the respective outer and inner external threads 70, 72 by segments 66D of the tie rod being substantially equal in lengths to the thicknesses of the outer casing 14 and inner ring structure 64.

The clamping means 68 also includes apertures 78, 80 defined respectively in the outer casing 14 and inner ring structure 64. The apertures 78, 80 receive the opposite outer and inner end portions 66B, 66C of each tie rod 66 such that its segments 66D extend through the apertures 78, 80 with the outer and inner lands 74, 76 disposed on opposite sides of the outer casing 14 and inner ring structure 64 from the outer and inner external threads 70, 72 of the tie rod 66. The lands 74, 76 provide stops against which the outer casing 14 and inner ring structure 64 seat. The clamping means 68 further includes a set of fasteners in the form of nuts 82, 84 having internal threads, adapting the nuts 82, 84 to be respectively screwed onto the outer and inner external threads 70, 72 on the opposite outer and inner end portions 66B, 66C of the tie rod 66. By screwing the nuts 82, 84 respectively toward the outer and inner lands 74, 76, the outer casing 14 and inner ring structure 64 become fixedly attached or clamped between the respective sets of nuts 82, 84 and lands 74, 76 and to the respective outer and inner end portions 66B, 66C of the tie rod 66. This prestresses the rods 66 to a predetermined value. Thus, the lands 74, 76 provide stops against which the outer casing 14 and inner ring structure 64 are seated by the fastening nuts 82, 84. This arrangement allows application of the proper amount of torque to the nuts 82, 84 and prevents over-stressing of the tie rods 66 while maintaining concentricity of the outer casing 14 and inner ring structure 64.

Each outer and inner land 74, 76 at the outer and inner end portions 66B, 66C of each tie rod 66 projects outwardly in transverse relation to the shaft 66A of the tie rod 66. Also, the outer land 74 includes a pair of land portions 74A, 74B being angularly displaced from one another about the tie rod 66 and protruding in transverse relation thereto. Preferably, the pair of land portions 74A, 74B of the outer land 74 is displaced 180° from one another and protrude in opposite directions relative to one another. The inner land 76 has a circular configuration such that it projects outwardly from the tie rod 66 the full 360° around the rod. An intermediate land 77 is provided approximately at the middle of each tie rod 66 and contains a recess 77A mounting a piston 79. The land 77 is of circular configuration also, projecting outwardly from the tie rod 66 the full 360° around the rod.

Each aperture 78 in the outer casing 14 has a configuration which matches that of the outer, inner and intermediate lands 74, 76, 77 on the tie rod 66 to allow passage of the lands through the aperture 78 during installing of each tie rod 66 through the outer casing 14 to the inner ring structure 64. A hex-shaped socket 86 is formed in the outer terminal end of each tie rod 66 for receiving a tool to use in turning each tie rod 66 through 90° after installation so that the outer lands 74 will seat properly against the interior surface of the outer casing 14.

Also, referring to FIG. 2, the bearing support assembly 12 includes an annular shell structure 88. The annular shell structure 88 preferably has a conical cross-sectional shape. The shell structure 88 is disposed forwardly of the tie rods 66, between and fixedly interconnecting the inner ring structure 64 and the stationary vanes 40 at attachment locations 90. Also, at several locations, seals 92, 94 are defined between the inner ring structure 64 and annular shell structure 88 on the one hand and the low and high pressure turbine rotors 34, 58. The shell structure 88 also has an aperture 95 through which the inner land 76 can pass during installing of the tie rod 66 and through which extends the intermediate land 77. The O-ring 79 is seated within the aperture 95. The interconnected annular shell structure 88, inner ring structure 64 and stationary vanes 40 act together as a unit to withstand axial loads induced by differences in air pressure existing axially through the outer casing 14, such as within the high pressure turbine 28 compared to the low pressure turbine 22.

Figure 8:
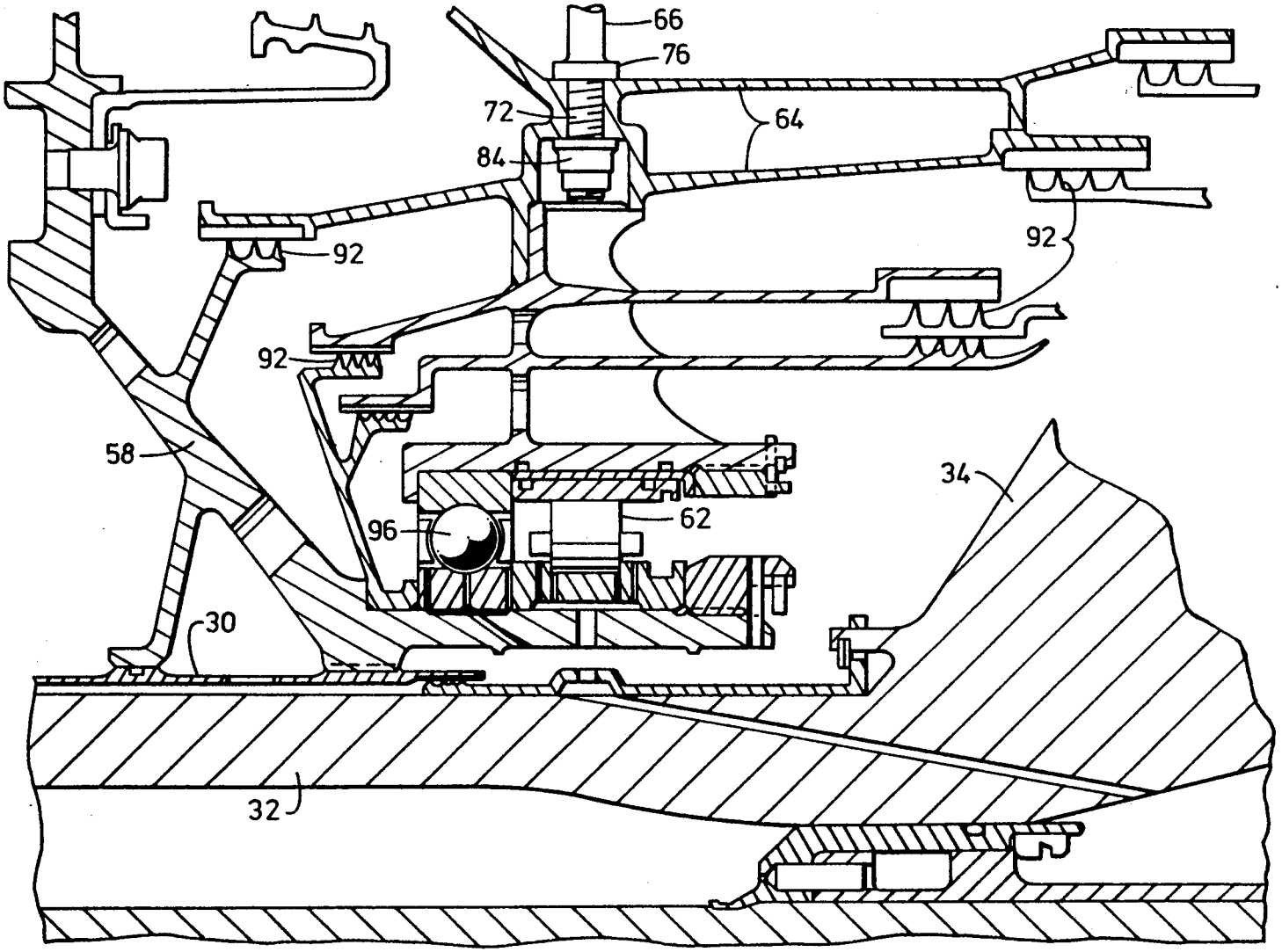
FIG. 8 is an enlarged fragmentary longitudinal axial sectional view of a modified form of a lower portion of the bearing support assembly.

Referring to FIG. 8, there is illustrated a modification to assist in withstanding axial loads. A ball bearing 96 is aligned axially side-by-side with the roller bearing arrangement 62. This arrangement permits the high pressure turbine rotor 58 to withstand part of the air pressure-induced axial load.

The advantages of the present invention is a replacement of a heavy, costly, thermally stress bound structure with the lightweight, low cost, low thermal stress bearing support structure 12. Both structures perform identical functions; however, the prior art one is heavy and expensive, while the alternative one of the present invention is extremely lightweight and low cost.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. In a gas turbine engine having a stationary outer annular casing, an inner annular bearing arrangement spaced radially inwardly from said outer casing, and a turbine rotor mounted by said inner annular bearing arrangement within said outer casing for rotation about a central axis relative to said outer casing and said inner bearing arrangement, a bearing support assembly, comprising:

(a) an inner ring structure extending about and mounting said inner annular bearing;

(b) a plurality of elongated tie rods each having opposite outer and inner end portions, said tie rods being disposed in circumferential spaced relation to one another and extending in radial relation to said central axis and between said outer casing and said inner ring structure;

(c) means for fixedly clamping said outer casing and inner ring structure respectively to said outer and inner end portions of said tie rods such that said tie rods, outer casing and inner ring structure act together as a unit to uniformly distribute bearing-induced radial loads and to withstand bearing-induced radial loads in both tension and compression; and (d) an annular shell structure disposed between and fixedly interconnecting said inner ring structure and said outer casing such that said annular structure, inner ring structure and outer casing act together as a unit to withstand axial loads induced by differences in air pressure existing axially through said outer casing.

2. The bearing support assembly as recited in claim 1, wherein said clamping means includes:

a set of external threads respectively formed on opposite terminal ends of said opposite outer and inner end portions of each of said tie rods;

a set of outwardly-protruding lands respectively formed on said opposite outer and inner end portions of each of said tie rods and being spaced from said respective external threads by segments of said tie rod substantially equal in lengths to the thicknesses of said outer casing and inner ring structure;

means defining apertures in said outer casing and inner ring structure for receiving said segments of said each tie rod so as to dispose said lands of said tie rod on opposite sides of said outer casing and inner ring structure from said external threads of said tie rod; and a set of fasteners having internal threads and being respectively screwed onto said external threads on said opposite terminal ends of each of said tie rods toward said lands so as to fixedly clamp said outer casing and inner ring structure between said respective sets of fasteners and lands.

3. The bearing support assembly as recited in claim 2, wherein each land at said outer and inner end portions of said each tie rod includes a pair of land portions angular displaced from one another about said tie rod and protruding in transverse relation to said tie rod.

4. The bearing support assembly as recited in claim 3, wherein each of said apertures in said outer casing has a configuration which allows passage of said land portions of each land on said tie rod through said aperture in order to permit installation of said tie rod through said outer casing to said inner ring structure.

5. The bearing support assembly as recited in claim 3, wherein said pair of land portions of each land are displaced 180° from one another and protrude in opposite directions relative to one another.

6. In a gas turbine engine having a stationary outer annular casing, an inner annular bearing arrangement spaced radially inwardly from said outer casing, a turbine rotor mounted by said inner annular bearing arrangement within said outer casing for rotation about a central axis relative to said outer casing and said inner bearing arrangement, and a plurality of stationary turbine stator vanes arranged in a circumferential row and fixedly attached to and extending radially inwardly from said outer casing toward said central axis, a bearing support assembly, comprising:

(a) an inner ring structure extending about and mounting said inner annular bearing;

(b) a plurality of elongated tie rods each having opposite outer and inner end portions, said tie rods being disposed in circumferential spaced relation to one another and extending through said stationary vanes in radial relation to said central axis and between said outer casing and said inner ring structure;

(c) means for fixedly clamping said outer casing and inner ring structure respectively to said outer and inner end portions of said tie rods such that said tie rods, outer casing and inner ring structure act as a unit to uniformly distribute bearing-induced radial loads and to withstand bearing-induced radial loads in both tension and compression; and (d) an annular shell structure disposed between and fixedly interconnecting said inner ring structure and said stationary vanes such that said annular structure, inner ring structure and stationary vanes act together as a unit to withstand axial loads induced by differences in air pressure existing axially through said outer casing.

7. The bearing support assembly as recited in claim 6, wherein said clamping means includes:

a set of external threads respectively formed on opposite terminal ends of said opposite outer and inner end portions of each of said tie rods;

a set of outwardly-protruding lands respectively formed on said opposite outer and inner end portions of each of said tie rods and being spaced from said respective external threads by segments of said tie rod substantially equal in lengths to the thicknesses of said outer casing and inner ring structure;

means defining apertures in said outer casing and inner ring structure for receiving said segments of said each tie rod so as to dispose said lands of said tie rod on opposite sides of said outer casing and inner ring structure from said external threads of said tie rod; and a set of fasteners having internal threads and being respectively screwed onto said external threads on said opposite terminal ends of each of said tie rods toward said lands so as to fixedly clamp said outer casing and inner ring structure between said respective sets of fasteners and lands.

8. The bearing support assembly as recited in claim 7, wherein each land at said outer and inner end portions of said each tie rod includes a pair of land portions angular displaced from one another about said tie rod and protruding in transverse relation to said tie rod.

9. The bearing support assembly as recited in claim 8, wherein each of said apertures in said outer casing has a configuration which allows passage of said land portions of each land on said tie rod through said aperture in order to permit installation of said tie rod through said outer casing to said inner ring structure.

10. The bearing support assembly as recited in claim 9, wherein said pair of land portions of each land are displaced 180° from one another and protrude in opposite directions relative to one another.

11. In a gas turbine engine having a stationary outer annular casing, an inner annular bearing arrangement spaced radially inwardly from said outer casing, a turbine rotor mounted by said inner annular bearing arrangement within said outer casing for rotation about a central axis relative to said outer casing and said inner bearing arrangement, and a plurality of stationary turbine stator vanes arranged in a circumferential row and fixedly attached to and extending radially inwardly from said outer casing toward said central axis, a bearing support assembly, comprising:

(a) an inner ring structure extending about and mounting said inner annular bearing;

(b) a plurality of elongated tie rods each having opposite outer and inner end portions, said tie rods being disposed in circumferential spaced relation to one another and extending through said stationary vanes in radial relation to said central axis and between said outer casing and said inner ring structure;

(c) fastening elements formed on said outer and inner end portions of said tie rods and on said outer casing and inner ring structure fixedly clamping said outer casing and inner ring structure respectively to said outer and inner end portions of said tie rods such that said tie rods, outer casing and inner ring act together as a unit to uniformly distribute bearing-induced radial loads and to withstand bearing-induced radial loads in both tension and compression; and (d) an annular shell structure having a conical cross-sectional configuration and disposed between and fixedly interconnecting said inner ring structure and said stationary vanes such that said annular structure, inner ring structure and stationary vanes act together as a unit to withstand axial loads induced by differences in air pressure existing axially through said outer casing.

12. The bearing support assembly as recited in claim 11, wherein said fastening elements includes:

a set of external threads respectively formed on opposite terminal ends of said opposite outer and inner end portions of each of said tie rods;

a set of outwardly-protruding lands respectively formed on said opposite outer and inner end portions of each of said tie rods and being spaced from said respective external threads by segments of said tie rod substantially equal in lengths to the thicknesses of. said outer casing and inner ring structure;

means defining apertures in said outer casing and inner ring structure for receiving said segments of said each tie rod so as to dispose said lands of said tie rod on opposite sides of said outer casing and inner ring structure from said external threads of said tie rod; and a set of fasteners having internal threads and being respectively screwed onto said external threads on said opposite terminal ends of each of said tie rods toward said lands so as to fixedly clamp said outer casing and inner ring structure between said respective sets of fasteners and lands.

13. The bearing support assembly as recited in claim 12, wherein each land at said outer and inner end portions of said each tie rod includes a pair of land portions angular displaced from one another about said tie rod and protruding in transverse relation to said tie rod.

14. The bearing support assembly as recited in claim 13, wherein each of said apertures in said outer casing has a configuration which allows passage of said land portions of each land on said tie rod through said aperture in order to permit installation of said tie rod through said outer casing to said inner ring structure.

15. The bearing support assembly as recited in claim 13, wherein said pair of land portions of each land are displaced 180° from one another and protrude in opposite directions relative to one another.

* * * * *